United States Patent [19]

Burgard

[11] Patent Number: 4,773,574

[45] Date of Patent: Sep. 27, 1988

[54] CHAIR PACK AND PACK FRAME

[76] Inventor: Francis A. Burgard, 12800 W. Cleveland Ave., New Berlin, Wis. 53151

[21] Appl. No.: 881,484

[22] Filed: Jul. 1, 1986

Related U.S. Application Data

[63] Continuation of Ser. No. 779,806, Sep. 25, 1985, abandoned, which is a continuation-in-part of Ser. No. 679,498, Dec. 7, 1984, abandoned.

[51] Int. Cl.[4] ..... A45F 4/02

[52] U.S. Cl. ..... 224/155; 224/210

[58] Field of Search ..... 224/155, 153, 151, 32 A; 297/2, 1, 118, 129; 108/17, 11, 26, 25; 383/7

[56] References Cited

U.S. PATENT DOCUMENTS

| | | | |
|---|---|---|---|
| 1,615,159 | 1/1927 | Bonner | 224/155 |
| 2,375,819 | 5/1945 | Reid | 383/7 X |
| 2,843,185 | 7/1958 | Clem et al. | 224/155 X |
| 2,922,465 | 1/1960 | Johansson et al. | 224/155 |
| 3,128,137 | 4/1964 | Dokter | 108/25 X |
| 3,250,449 | 5/1966 | Woodman | 224/155 |
| 3,842,936 | 10/1974 | Deluca | 108/26 X |
| 3,997,213 | 12/1976 | Smith et al. | 297/118 |
| 4,099,647 | 7/1978 | Bergh et al. | 220/334 |
| 4,236,657 | 12/1980 | Brunton | 224/153 |
| 4,248,367 | 2/1981 | Buel | 224/153 |
| 4,387,924 | 6/1983 | Fernandez | 224/155 X |
| 4,442,960 | 4/1984 | Vetter | 224/32 A |
| 4,487,345 | 12/1984 | Pierce et al. | 224/155 |
| 4,489,866 | 12/1984 | Korte | 224/155 |
| 4,491,258 | 1/1985 | Jones | 224/32 A X |
| 4,530,451 | 7/1985 | Hamilton | 224/155 |
| 4,541,666 | 9/1985 | Vanderminden | 297/16 |
| 4,580,706 | 4/1986 | Jackson et al. | 224/32 A |
| 4,635,667 | 1/1987 | Harn | 135/90 |

FOREIGN PATENT DOCUMENTS

| | | | |
|---|---|---|---|
| 108896 | 3/1900 | Fed. Rep. of Germany | 224/155 |
| 342611 | 10/1921 | Fed. Rep. of Germany | 224/155 |
| 197550 | 4/1957 | Fed. Rep. of Germany | 224/155 |
| 58080 | 6/1937 | Norway | 224/155 |
| 2128471 | 5/1984 | United Kingdom | 224/155 |

*Primary Examiner*—Henry J. Recla
*Assistant Examiner*—Robert M. Petrik
*Attorney, Agent, or Firm*—Bayard H. Michael

[57] ABSTRACT

The pack frame has first and second rectangular frames pivotally interconnected to allow the frames to be opened to the limit imposed by a fabric seat mounted between the top members. A safety strap connects the bottom frame members to act as a back-up limit on separation of the frames. The frames can be collapsed or folded and carried by shoulder straps connected to one of the frames at the top cross member and to the sides of the frame below the pivot. An optional backrest is fixed to the one frame to serve to support cargo when the frames are used as a backpack or to pivot, by removal of one of two mounting pins on each side to a lowered position, or to serve as a backrest when the seat is used. Optional side cargo bags are mounted to the pivot pins and are connected to each other by a strap passing over the seat. The invention also provides a spliced joint for each rectangular frame in the medial portion of the lower cross member. The splice has a tubular frame end fit over a fixed sleeve and is retained by a pin which also fixes the end of the safety strap. In one embodiment the tapered top of a box is fitted inside the inner frame and is held in that position the clevis pins which serve as the pivot pins for the frames.

6 Claims, 4 Drawing Sheets

CHAIR PACK AND PACK FRAME

This is a continuation of co-pending application Ser. No. 779,806, filed on Sept. 25, 1985, which is a continuation-in-part of Ser. No. 679,498, filed Dec. 7, 1984, both now abandoned.

FIELD OF THE INVENTION

This invention relates to a pack frame assembly which can be utilized as a seat, a backpack, a tackle box carrier and for many other uses.

BACKGROUND OF THE INVENTION

The prior art has provided portable seats which include storage capacity for shotgun shells, etc. The most popular of these designs has legs which sink into soft ground. Another design has cross members at the bottom of the legs and this helps somewhat in preventing the chair from sinking into soft ground. However, it still happens. None of the designs provide for carrying as a backpack. Nor could they be adapted to increase the cargo carrying capacity. One design provides a backrest but it is a rather flimsy affair having no use other than serving as a backrest, that is, it cannot be used to support cargo or the like when the rig is carried.

SUMMARY OF THE INVENTION

This invention provides first and second rectangular frames pivotally interconnected to allow the frames to be opened to the limit imposed by a fabric seat mounted between the top members. A safety strap connects the bottom frame members to act as a back-up limit on separation of the frames.

The frames can be collapsed or folded and carried by shoulder straps connected to one of the frames at the top cross member and to the sides of the frame below the pivot.

An optional back support is provided. It is fixed to the frame to support cargo when the frames are used as a backpack or to pivot, by removal of one of two mounting pins on each side, to a lowered position, or to serve as a backrest when the seat is used.

Optional side cargo bags are mounted to the pivot pins and are connected to each other by a strap passing over the seat.

The invention also provides a spliced joint for each rectangular frame in the medial portion of the lower cross member. The splice has a tubular frame end fitting over a fixed sleeve and is retained by a pin which also fixes the end of the safety strap. The spliced joint enables removal of the seat/bag assembly for cleaning or replacement by a simple seat used in conjunction with a tackle box secured to the frame on the same clevis pins which function as the pivots for the frames.

BRIEF DESCRIPTION OF THE DRAWINGS

FIG. 3 is a side view of the construction in use as a backpack and in dotted lines it shows the backrest lowered to keep clear of brush and the like.

DETAILED DESCRIPTION OF THE DRAWINGS

Figure 2:
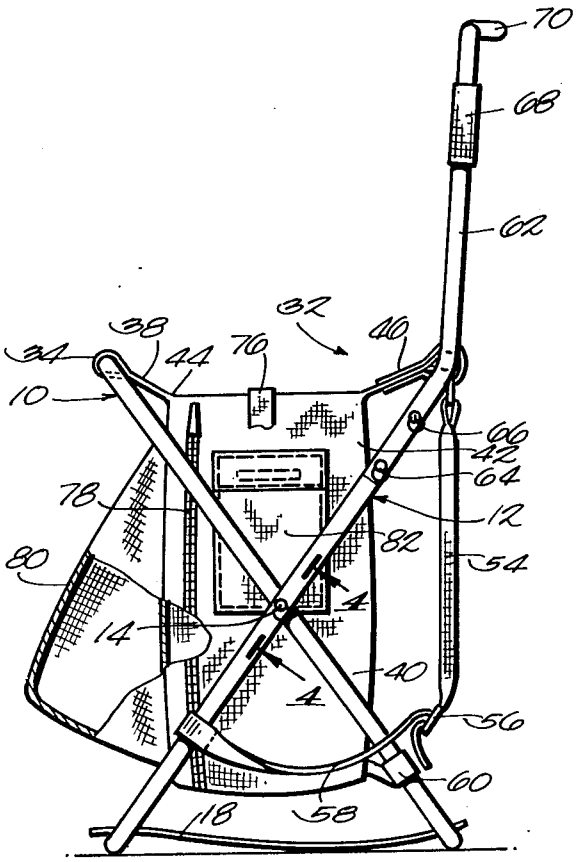
FIG. 2 is a side elevation of FIG. 1.

The seat frame is made up of two pivotally connected rectangular frames 10, 12. The frames are pivotally connected by means of clevis pins 14 which serve as pivots. The clevis pins are retained in assembled position by the cotter rings 6. Frame 10 is narrower than and fits inside of rame 12. The lower frame members are interconnected by a safety strap 18 having each end provided with a grommet through which the shank of the clevis pin 20 passes to fix the end of the strap relative to the frame. The clevis pin 20 is retained by the cotter ring 22. The pin serves to pin the spliced joint together and may be called a splice pin. The clevis pin 20 also passes through the sleeve 24 fixed inside tube 26 by rivet 28. When the clevis pin 20 is removed, the safety strap is disconnected and the two ends 26, 30 of the tubular frame can be separated, that is, the end 30 is slipped off the inner sleeve 24. This then permits the bag to be slipped off the frame for cleaning or for exchange for the purpose of changing color or to put on a camouflage-type material for a hunter, or for other purposes such as mounting a simple seat used with the tackle box as described later.

Figure 1:
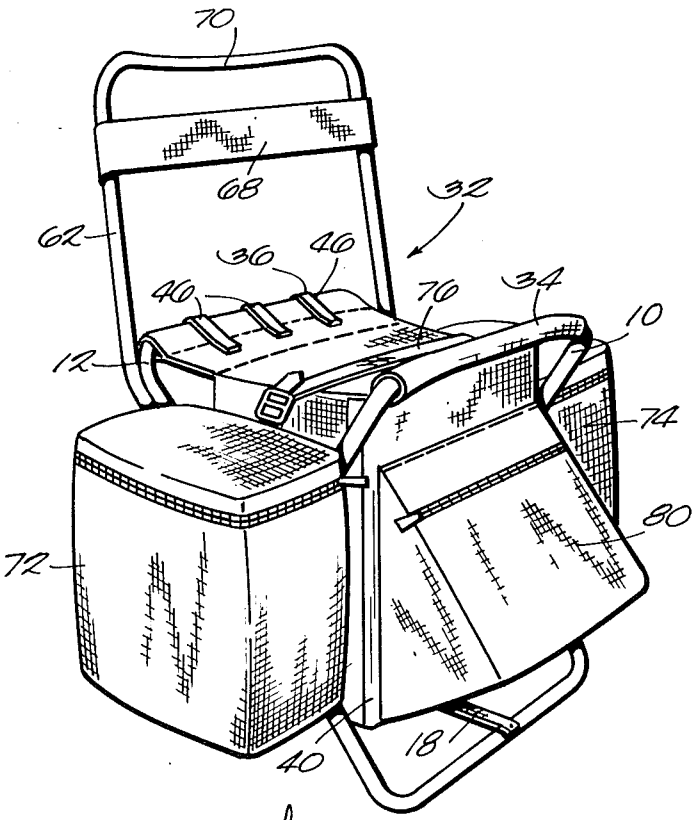
FIG. 1 is a perspective view of the pack set up as a seat complete with backrest.
Figure 4:
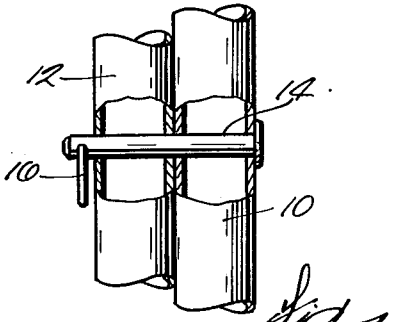
FIG. 4 is an enlarged sectional view taken on line 4—4 in FIG. 2.
Figure 5:
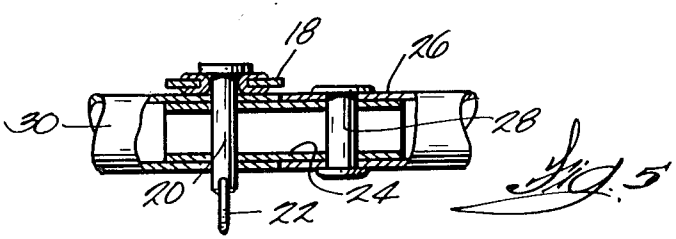
FIG. 5 is a section taken through the bottom rail as indicated by line 5—5 in FIG. 3.
Figure 6:
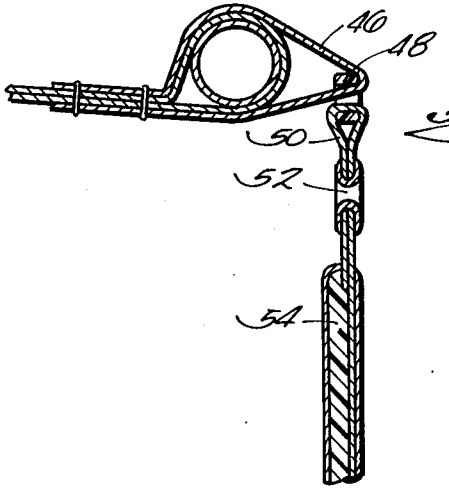
FIG. 6 is a detail of the method of attaching the upper end of the pack strap.

The top cross members of the two rectangular frames have the pack/chair 32 connected thereto. The fabric is stitched to provide a tunnel 34 which slips over the frame 10 until it is at the top cross member of the frame 10. The rear of the seat also has a tunnel 36 which is slipped over the frame 12 until it is on the cross member at the back of the seat. The fabric seat 38 stretches between the front and back of the seat when the frame members are in the open position as illustrated in FIGS. 1 and 2. The storage bag 40 hangs down from the seat 38. It will be noted that the back panel 42 of the bag 40 is spaced from the upper back cross frame or horizontal member of the frame 12 to permit the back panel 42 to lie forwardly, i.e., away from the user's back, of the collapsed frames when the frames are closed as in FIG. 3. Similarly, the front-to-back depth of the fabric between the front corner 44 of the bag and the upper front cross member of frame 10 is fairly substantial to allow the bag to swing rearwardly of the collapsed frames when functioning as a backpack frame as in FIG. 3.

Figure 3:
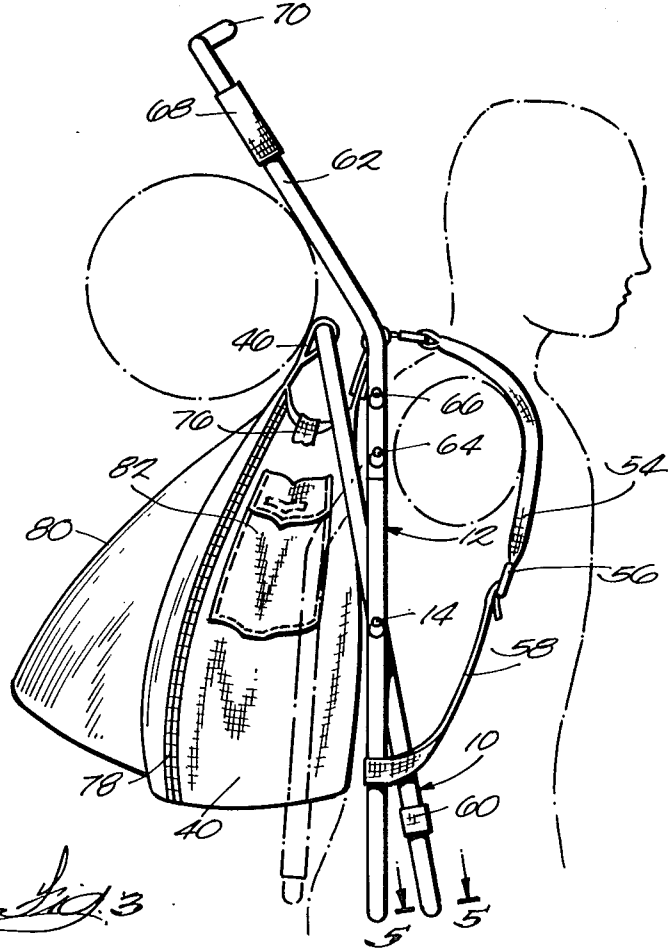

The frame is provided with two carrying straps. At the upper end the carrying strap connects to the heavy-duty straps 46, 46 stitched to the rear portion of the seat and passing over the tunnel 36 and the frame member. A "D" ring 48 is captured by this trap and the shoulder strap 50 also passes through "D" ring. The upper end of the strap 50 is secured by a grommet 52 while the main portion of the strap passes through the foam shoulder pad assembly 54 and is stitched relative thereto. This prevents twisting the strap relative to the pad or letting the pad slide up and down the strap. The strap 50 exits the lower end of the pad 54 and has a buckle 56 secured thereto. A strap 58 is sewn around the frame at the side below the pivot pin 14 and can slide up and down the frame at that point. When the backpack is in use, the tension on the shoulder strap tends to pull the frame member 12 to the wearer's back and will function to collapse the frame. The lower end of the frame 10 has a "fanny strap" 60 connected between tne two sides of the frame 10 and is adapted to rest on the wearer's fanny or hips. This then tends to close the frame while the pack can assume a natural position as shown in FIG. 3, somewhat to the rear of the folded frames.

A backrest 62 is optionally mounted on the frame 12. It is in the general shape of an inverted U with the lower end of each leg bent at an obtuse angle so the back frame 62 projects upwardly in a generally vertical position when each leg is secured to frame 12 by two clevis pins 64, 66. A strap 68 extends between the two legs of the backrest frame 62 and acts as a back support when the user leans against the backrest. In transport, it may be desireable to lower the backrest to avoid getting caught on tree branches and brush. For this purpose, the upper clevis pin 66 on each side is removed and the frame is pivoted down to the position shown in dotted lines in FIG. 3 where it is out of the way. The backrest strap 68 can be left in position and will just lie under the bag in the lowered position.

The upper cross member 70 of the backrest is slightly bowed rearwardly to avoid being engaged by a seated person. Normally with pack frames, the upper cross member is bowed away from the user's back. Here it is bowed toward the user's back, but that represents no problem even with the backrest in the raised position as shown in FIG. 3 in solid lines. This is because the angle of the connection between the frame 12 and the backrest automatically positions the entire backrest away from the user's head and will not bother the user or a hat worn by the user.

Since the backrest can be rigidly fixed in the raised position, it can be used for tying a bedroll or the like to the frame. Thus, it serves to extend the utility of the pack frame when it is not being used as a backrest for a seated person.

The assembly can be provided with side pockets 72, 74 as an optional feature. The two side pockets are interconnected across the seat by means of strap 76. To stablize the pockets on the side of the frame, the pivot pins 14 pass through grommet holes in the inside panel of the side pocket and the snap ring 16 is then secured. This then fixes the side pockets 72, 74 relative to the frame.

It will be noted that access to the main bag 40 is through the vertical zippers 78 at the front of each side of the bag. This makes it easy to get into the bag even when the bag is hanging down from the frame and the frame is serving as a seat. The front pocket 80 is permanently fixed to the bag and is separate from the other storage. Similarly, the bag can be provided with side pockets 82 fixed directly on the bag, i.e., underneath the pockets 72, 74 and inside the frame member. Additional pockets can be provided on the panel adjacent the user's back if desired.

The safety strap 18 serves to prevent overloading the frame by having the legs start spreading on soft ground and imposing consequent very high load on the frame with likely damges. Normally, the safety strap 18 is slightly slack when the seat is set up. This ensures that the seat will be drawn tight as the user sits down. The safety strap prevents the frame spreading too far. If the legs tend to sink into soft ground, the safety strap engages the ground and offers additional resistance to sinking. The safety strap imparts so much strength to the frame that one of the two pivot pins can be removed and the frame used as a seat without collapsing the frame.

Figure 8:
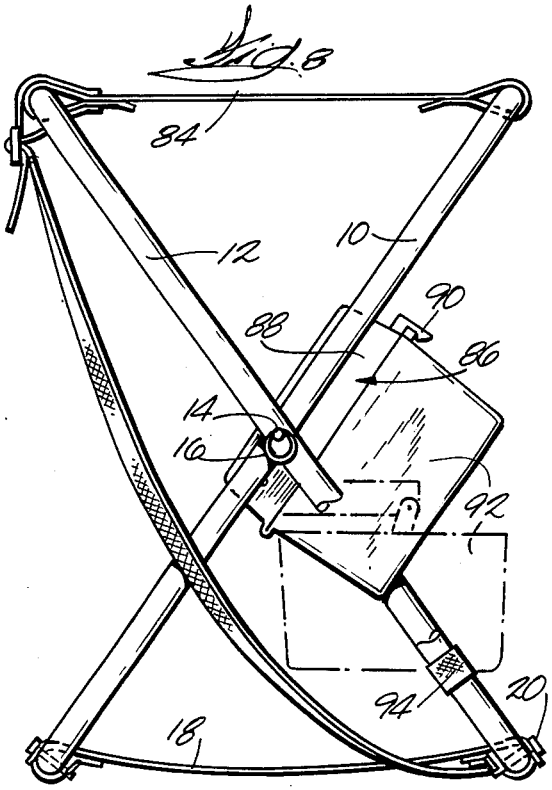
FIG. 8 is a side elevation of the seat set up before the box is opened, the box being shown open in dashed lines.
Figure 9:
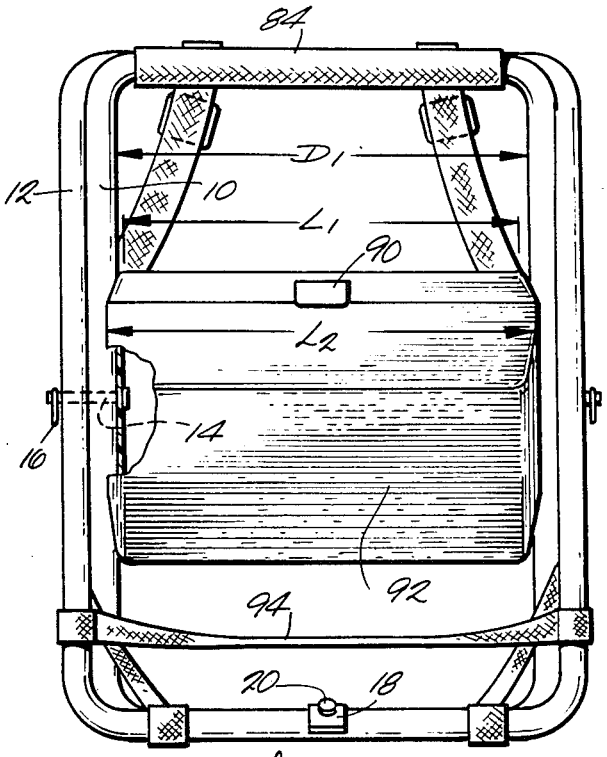
FIG. 9 is an elevation view of the seat as seen from the right in FIG. 8.
Figure 7:
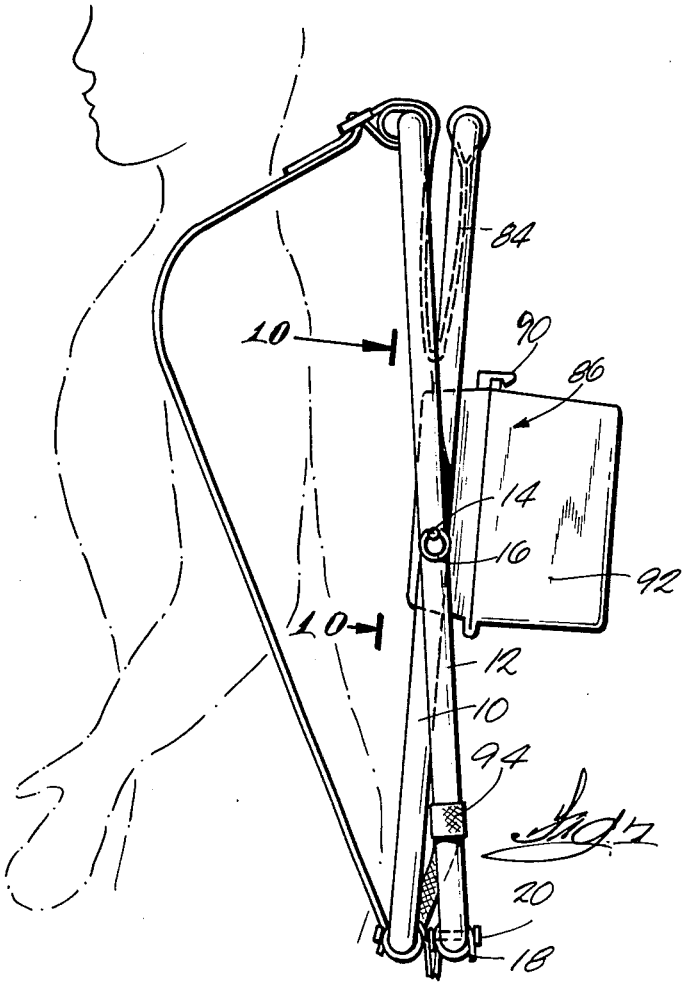
FIG. 7 shows how a person carries a folded pack frame fitted with a fabric seat and a (fishing) tackle box.
Figure 10:
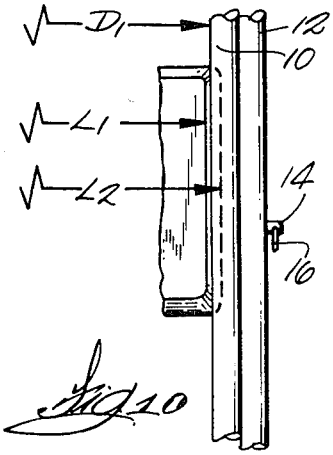
FIG. 10 is a detail view taken from line 10—10 in FIG. 7.

As indicated above, the seat/bag can be removed easily for replacement by a simple seat 84 as shown in FIGS. 7 and 8 which illustrate a fisherman's seat provided with a tackle box 86. All four sides of the top 88 slope inwadly so the length $L_1$ of the top is less than the distance $D_1$ between the sides of the inside frame 10. The length $L_2$ of the bottom of the top of the box is greater than $D_1$. This permits rigidly fixing the box top to the frame by fitting it snugly between the sides of frame 10 and passing the pivot/clevis pins 14 through holes in the box top and through the pivot holes in the frames 10, 12. The head of each clevis pin 14 engages the inside of the top 88 and ring 16 retains the pin. When the frames are folded to be carried as in FIG. 7, the box is held fixed to the frame as shown.

When the seat is put into use the latch 90 on the box is opened and the bottom 92 can open up. Preferably a strap 94 between the legs of frame 12 is positioned to support the bottom in a horizontal position as in dashed lines in FIG. 8. If there is no strap, the box opens until the lower front edge hits the ground.

Other ways can be devised to mount boxes to the frame. The method shown is simple and is very satisfactory.

Figure 11:
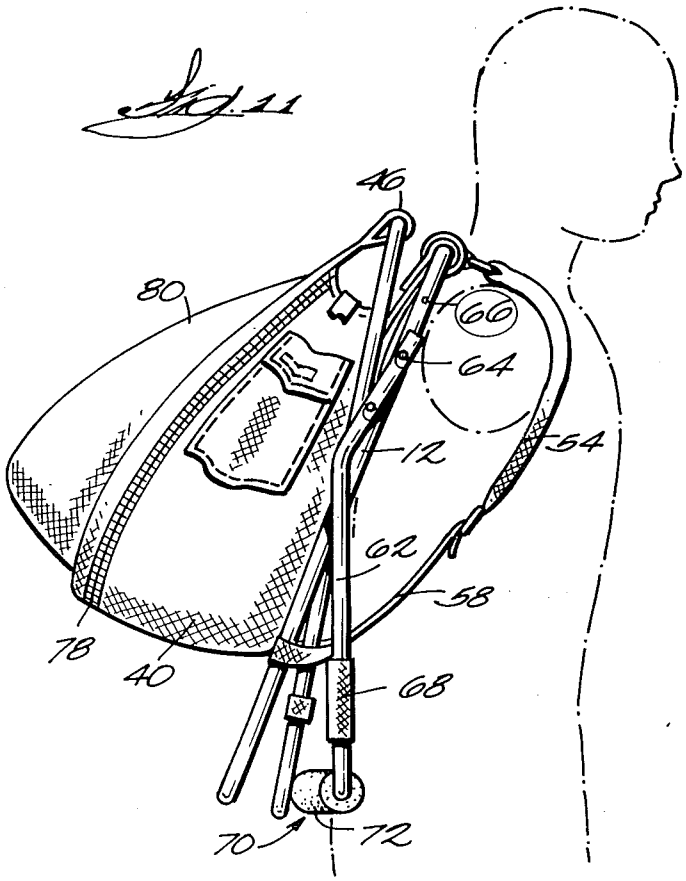
FIG. 11 is a view similar to FIG. 3 but shows the backrest folded down to a position inside the collapsed frame members to enable the backrest strap to engage the user's waist or hips in the manner of a true pack frame.

Turning now to FIG. 11, it will be noted that the backrest has been folded down by pivoting the backrest about the clevis pin 64. To do this, the clevis pin 66 must be removed so the two pins 64, 66 no longer function to align the backrest with the side of the frame 12. In the drawing the clevis pin hole in the frame is marked with the reference numeral 66 which is encircled to indicate that the pin has been removed. This permits the frame to be pivoted clockwise about the lower clevis pin 64. This takes the backrest inside the collapsed frames so the back support strap 68 will now rest on the user's waist or hips and will function to help support a heavy load much the same way as the "fanny strap" in a pack frame operates. It will be noted that the cross member 70 is provided with a foam pad 72 which prevents that portion being bothersome to the user. This foam pad is also comfortable if the back strap permits the user's back to hit the cross member 70 when the apparatus is used as a seat.

Figure 12:
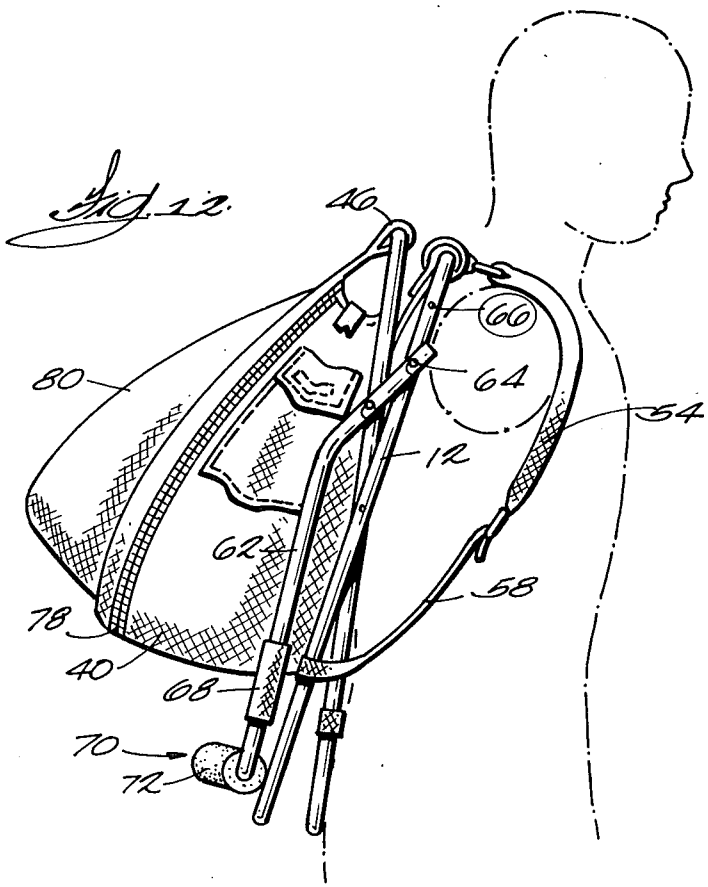
FIG. 12 is similar to FIG. 11, but in this view the backrest frame is pivoted down to be outside the collapsed frame members.

When traveling through brush the upstanding backrest support 62 (FIG. 3) can be bothersome. In that instance, even with a light load not requiring the fanny strap, tne upper clevis pin can be removed, as in FIG. 12, to pivot the backrest counter-clockwise about clevis pin 64 to lie outside the collapsed frames as illustrated in FIG. 12.

I claim:

1. A pack frame and seat device, comprising, first and second tubular closed rectangular frames each having parallel side legs and parallel top and bottom member, a fabric seat connected to the top member of both of said frames, the legs of the two frames being pivotally interconnected so said top members are uppermost when the device is used as a pack frame with the top members brough together or as a seat with the top members spread apart with said seat spanning the space between said top members, a safety strap connected to the medial portion of each of said bottom members and extending between said bottom members to limit separation of the bottom members when the device is used as a seat, the legs of said frames are pivotally interconnected by a pin extending through each pair of legs, and including, a pair of shoulder straps connected to the top member of said first frame which top member lies adjacent the user's back, each strap being connected to the lower leg of said first frame below said pivot pin, including a pack bag depending from said seat between and below the top member both of said frames when said device is used as a seat whereby said seat is the top of said pack bag, said first frame being wider than said second frame and fitting outside said second frame, and including, a separate backrest frame connected to the upper portions of the legs of said first frame, said backrest frame being in the general shape of an inverted U with the lower end of each backrest leg being connected to the upper portions of said first frame and being bent so the backrest frame is generally vertical when the first and second frames are opened to form a seat.

2. The apparatus of claim 1 in which each backrest leg is connected to said first frame leg by two pins which fix said backrest frame relative to said first frame while allowing removal of one of the two pins on each backrest leg so said backrest frame can pivot about the remaining pin of said two pins and lowered to a position generally overlying said first and second frames when the assembly is used as a backpack.

3. The apparatus of claim 2 including a back support strap between the legs of said backrest frame, the top cross member of said backrest frame being bowed away from a person on said seat.

4. The apparatus of claim 3 including a vertical zipper on each side of said pack bag adjacent the front panel of the bag remote from the user's back.

5. The apparatus of claim 1 including a separate side bag on each side of said frames, a hole in each side bag and facing said frames, the pivot pin on each side of the frames extending through said hole in the adjacent side bag, and means engaging each said pin and said side bag to retain each side bag on said frames, and a strap interconnecting said side bags and extending over said seat.

6. Apparatus according to claim 3 in which said backrest can also pivot about said remaining pin and be lowered to a position inside the lower portions of said first and second frames when the assembly is used as a backpack and in which position said support strap engages the user near the waist and said top cross member is bowed away from the user.

* * * * *